US010801527B2

(12) United States Patent
Hasuo

(10) Patent No.: US 10,801,527 B2
(45) Date of Patent: Oct. 13, 2020

(54) DRIVING APPARATUS

(71) Applicant: FANUC CORPORATION, Yamanashi (JP)

(72) Inventor: Takeshi Hasuo, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 0 days.

(21) Appl. No.: 16/379,973

(22) Filed: Apr. 10, 2019

(65) Prior Publication Data

US 2019/0360506 A1 Nov. 28, 2019

(30) Foreign Application Priority Data

May 24, 2018 (JP) ..... 2018-099811

(51) Int. Cl.
*F15B 15/20* (2006.01)

(52) U.S. Cl.
CPC ..... *F15B 15/20* (2013.01); *F15B 2015/206* (2013.01)

(58) Field of Classification Search
CPC ..... F15B 15/20
USPC ..... 92/145
See application file for complete search history.

(56) References Cited

U.S. PATENT DOCUMENTS 2,698,602 A * 1/1955 Olcott ..... B04B 11/04 92/118
4,753,128 A * 6/1988 Bartlett ..... B25J 19/0016 16/401
4,904,150 A * 2/1990 Svensson ..... B25J 19/0012 188/382
6,298,941 B1 * 10/2001 Spadafora ..... B62D 3/14 180/417
6,840,404 B1 * 1/2005 Schultz ..... B01F 15/0466 222/137
9,156,199 B2 * 10/2015 Notz ..... B29C 45/5008
2003/0000765 A1 * 1/2003 Spadafora ..... B62D 5/062 180/422
2004/0065974 A1 * 4/2004 Dantlgraber ..... B29C 45/5008 264/40.5
2007/0128056 A1 * 6/2007 Haudenschild ..... F04B 9/02 417/415
2008/0056858 A1 3/2008 Tamura et al.
(Continued)

FOREIGN PATENT DOCUMENTS

EP 1 894 683 A1 3/2008
JP 2003-048599 A 2/2003
(Continued)

OTHER PUBLICATIONS

Office Action dated Mar. 31, 2020, in corresponding Japanese Application No. 2018-099811; 7 pages.

*Primary Examiner* — Thomas E Lazo
(74) *Attorney, Agent, or Firm* — Maier & Maier, PLLC

(57) ABSTRACT

This driving apparatus includes a motor drive capable of moving a movable portion toward a predetermined direction by an output of a servo motor, an air cylinder drive capable of moving the movable portion toward the predetermined direction by an output of an air cylinder, and a controller which controls the motor drive and the air cylinder drive, and the controller moves the movable portion toward the predetermined direction by using the air cylinder drive and the motor drive.

4 Claims, 6 Drawing Sheets

(56) References Cited

U.S. PATENT DOCUMENTS

| | | | | |
|---|---|---|---|---|
| 2013/0209201 | A1* | 8/2013 | Furuichi | H01L 21/67766 414/226.05 |
| 2014/0083289 | A1* | 3/2014 | Simmons | F15B 7/08 92/145 |
| 2014/0290414 | A1* | 10/2014 | Hasuo | B25J 19/0012 74/490.01 |
| 2016/0016569 | A1* | 1/2016 | Odaira | B60T 7/042 303/15 |
| 2016/0341226 | A1* | 11/2016 | Heverly, II | F04B 1/00 |

FOREIGN PATENT DOCUMENTS

| | | | |
|---|---|---|---|
| JP | 2008-055550 | A | 3/2008 |
| JP | 2008-073823 | A | 4/2008 |
| JP | 2008-119791 | A | 5/2008 |
| JP | 2013-076432 | A | 4/2013 |
| JP | 2013-165241 | A | 8/2013 |
| JP | 2014-020515 | A | 2/2014 |
| JP | 2017-019078 | A | 1/2017 |
| JP | 2018-009593 | A | 1/2018 |

* cited by examiner

DRIVING APPARATUS

CROSS-REFERENCE TO RELATED APPLICATIONS

This application is based on and claims priority to Japanese Patent Application No. 2018-099811 filed on May 24, 2018, the entire content of which is incorporated herein by reference.

FIELD

This invention relates to a driving apparatus.

BACKGROUND

Conventionally, there is a known driving apparatus which moves an elevation base, which is a movable portion, toward a predetermined direction by means of a plurality of air cylinders.

Also, there is a known driving apparatus which drives a movable portion by means of a servo motor.

SUMMARY

A driving apparatus according to a first aspect of the present invention includes a motor drive capable of moving a movable portion toward a predetermined direction by means of output of a servo motor; an air cylinder drive capable of moving the movable portion toward the predetermined direction by means of output of an air cylinder; and a controller which controls the motor drive and the air cylinder drive, wherein the controller moves the movable portion toward the predetermined direction by using the air cylinder drive and the motor drive.

DETAILED DESCRIPTION

A driving apparatus 1 according to a first embodiment of the present invention will be described below with reference to the accompanying drawings.

Figure 1:
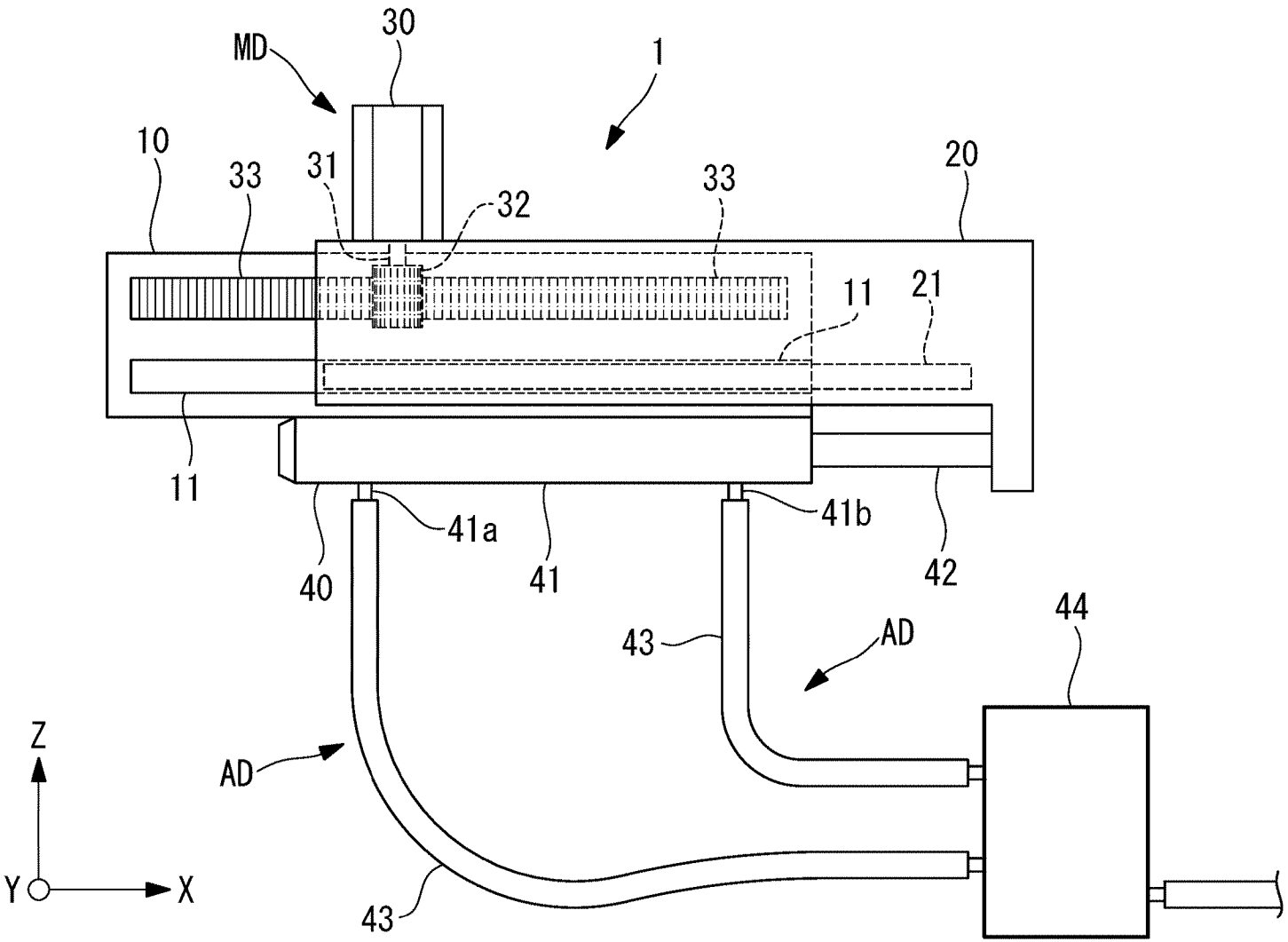
FIG. 1 is a front view of a driving apparatus according to an embodiment of the present invention.

As shown in FIG. 1, the driving apparatus 1 according to this embodiment includes a base member 10 which is long in an X-axis direction, and a movable portion 20 which is a slider and which is attached to the base member 10 so as to be movable in a longitudinal direction of the base member 10. In FIG. 1, the X-axis direction is a horizontal direction, a Z-axis direction is a vertical direction, and a Y-axis direction is a horizontal direction orthogonal to the X-axis direction and the Z-axis direction. In this embodiment, the driving apparatus 1 is a linear motion apparatus.

The base member 10 is made of metal, a hard plastic, and the like, and a groove 11, which extends in the longitudinal direction of the base member 10, is formed on the base member 10.

The movable portion 20 is made of metal, a hard plastic, and the like, and a rail 21 is provided on the movable portion 20. By engaging the rail 21 with the groove 11, the movable portion 20 is supported by the base member 10 so as to be movable in the longitudinal direction of the base member 10.

Also, in order to achieve smooth sliding between the rail 21 and the groove 11, a steal ball, which is held by a holder, may be placed between the rail 21 and the groove 11.

A servo motor 30 is fixed to the movable portion 20, and a pinion gear 32 is attached to an output shaft 31 which rotates in response to output of the servo motor 30. The servo motor 30 has a built-in operation position detection apparatus, such as an encoder, and the like, and detected results of the operation position detection apparatus are sent to a controller 50 described below. And, the controller 50 uses the detected results of the operation position detection apparatus to control the servo motor 30.

On the other hand, a rack gear 33, which extends in the longitudinal direction of the base member 10, is fixed to the base member 10, and the rack gear 33 and the pinion gear 32 are engaged. With this configuration, the movable portion 20 moves in response to the operations of the servo motor 30. That is to say, a motor drive MD, which is capable of moving the movable portion 20 in the longitudinal direction of the base member 10, has the servo motor 30, the pinion gear 32, and the rack gear 33. Also, a speed reducer may be provided between the servo motor 30 and the output shaft 31.

In addition, a main body 41 of an air cylinder 40 is fixed to the base member 10, and a distal end of an output shaft 42 of the air cylinder 40 is fixed to the movable portion 20. With this configuration, the movable portion 20 moves in the longitudinal direction of the base member 10 in response to operations of the air cylinder 40. Two intake and exhaust ports 41*a*, 41*b* of the main body 41 are respectively connected to a cylinder controller 44 via an air supply pipe 43, and the cylinder controller 44 is connected to an air supply source which is not shown.

Moreover, a known solenoid valve is provided inside the cylinder controller 44, and air is selectively supplied to the intake and exhaust port 41*a* and the intake and exhaust port 41*b* by means of the solenoid valve. That is to say, an air cylinder drive AD, which is capable of moving the movable portion 20 in the longitudinal direction of the base member 10, has the air cylinder 40 and the cylinder controller 44. The air cylinder drive AD may have other configurations, such as a known link mechanism and the like.

Figure 2:
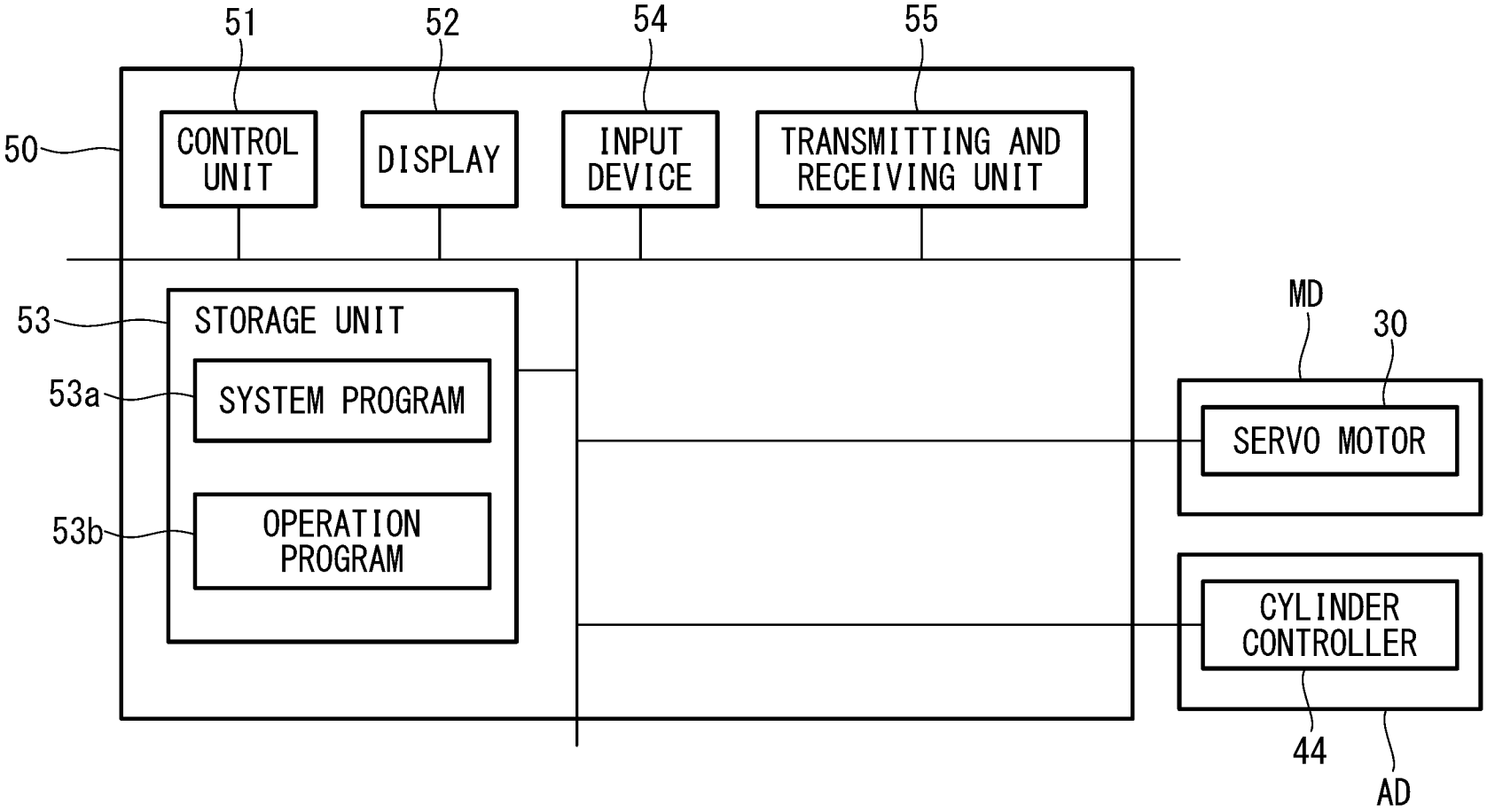
FIG. 2 is a block diagram of a controller of the driving apparatus of the embodiment.

As shown in FIG. 2, the controller 50 includes a control unit 51 having a processor and the like, a display 52, a storage unit 53 having a non-volatile storage, a ROM, a RAM, and the like, an input device 54 which is a key board, a touch panel, an operation panel, and the like, and a transmitting and receiving unit 55 for transmitting and receiving signals. The input device 54 and the transmitting and receiving unit 55 function as an input unit. The controller 50 sends control signals to the servo motor 30 and the cylinder controller 44 so as to control the servo motor 30 and the cylinder controller 44.

A system program 53*a* is stored in the storage unit 53, and the system program 53*a* provides a basic function of the controller 50. Also an operation program 53*b* is stored in the storage unit 53. The operation program 53*b* is a series of control commands which controls the servo motor 30 and the cylinder controller 44 at the time of performing a predetermined operation using the movement of the movable portion 20.

In this embodiment, the control unit 51 sends the control signals to the servo motor 30 and the cylinder controller 44 on the basis of the operation program 53*b* so as to move the movable portion 20 with regard to the base member 10. For example, an operation which moves the movable portion 20 toward the right side in FIG. 1, and an operation which moves the movable portion 20 toward the left side in FIG. 1 are performed alternately.

Among the above described operations, an example shown below is of the control performed by the control unit 51 at the time of moving the movable portion 20 toward the right side in FIG. 1. In the below description, the direction toward the right side in FIG. 1 is referred to as a predetermined direction, however, it is also possible to refer to the direction toward the left side in FIG. 1 as the predetermined direction.

Figure 3:
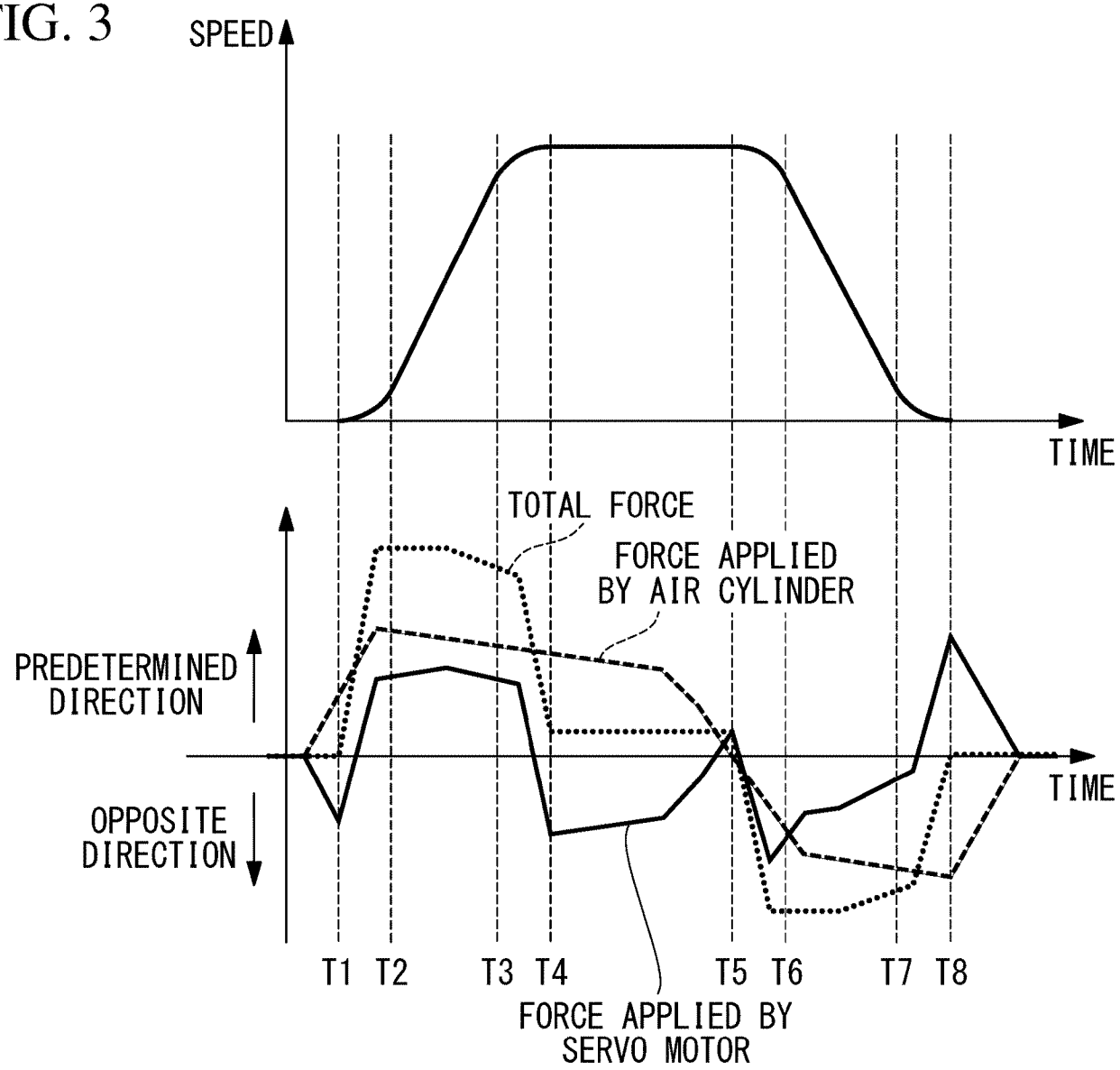
FIG. 3 is a time chart showing one example of operations of the driving apparatus of the embodiment.

(Example of Control Shown in the Time Chart of FIG. 3)

In the example shown in FIG. 3, from time T1, the control unit 51 starts to move the movable portion 20 toward the predetermined direction (starts to accelerate the movable portion 20). Also, the control unit 51 moves the movable portion 20 toward the predetermined direction at constant acceleration between time T2 and time T3. Also, between time T3 and time T5, the control unit 51 gradually reduces the acceleration so that the movable portion 20 moves at the constant speed. And, from time T5, the control unit 51 starts to reduce the speed of the movable portion 20. Moreover, between time T6 and time T7, the control unit 51 reduces the speed of the movable portion 20 at constant acceleration. In addition, the control unit 51 stops the movable portion 20 at time T8.

When the control unit 51 starts to move the movable portion 20 at time T1, the control unit 51 starts to control the cylinder controller 44 of the air cylinder drive AD from a point in time prior to time T1 so that the air cylinder 40 starts to apply force which is directed in the predetermined direction to the movable portion 20. In this example, the force directed in the predetermined direction, which is applied by the air cylinder 40, gradually becomes larger before and after time T1.

On the other hand, the control unit 51 starts to control the servo motor 30 of the motor drive MD from a point in time prior to time T1 so that the servo motor 30 starts to apply force, which is directed in the direction opposite to the predetermined direction, to the movable portion 20. In this example, the force directed in the opposite direction, which is applied by the servo motor 30, gradually becomes larger as time passes until time T1. In this state, the force directed in the predetermined direction is applied to the movable portion 20 by means of the air cylinder 40, whereas the force directed in the opposite direction is applied to the movable portion 20 by means of the servo motor 30, which renders the movable portion 20 to be stationary.

Subsequently, time T1 has passed, the control unit 51 gradually reduces the force directed in the opposite direction, which is applied by the servo motor 30, and after the force directed in the opposite direction becomes zero, the control unit 51 starts to apply the force directed in the predetermined direction to the movable portion 20 by the servo motor 30. In this example, the force directed in the predetermined direction, which is applied by the servo motor 30, gradually becomes larger.

By this operation, at time T1, the movable portion 20 starts to move toward the predetermined direction by the force applied by the air cylinder 40.

In this control, from a point in time prior to time T1, the air cylinder 40 starts to apply the force directed in the predetermined direction to the movable portion 20, and the servo motor 30 starts to apply the force directed in the opposite direction to the movable portion 20. Also, when time T1 has passed, the control unit 51 starts to reduce the force directed in the opposite direction, which is applied by the servo motor 30. Also, the servo motor 30 may start to apply the force directed in the predetermined direction to the movable portion 20 from time T1. With this control, it is possible to move the movable portion 20 stably at the large acceleration or by the large force from a point in time at which the movement of the movable portion 20 has started.

In order to accelerate the movable portion 20 between time T2 and T3, the force directed in the predetermined direction is applied to the movable portion 20 by the air cylinder 40 and the servo motor 30.

Between time T3 and time T5, in a state where the force directed in the predetermined direction is continuingly applied to the movable portion 20 by means of the air cylinder 40, the control unit 51 gradually reduces the force applied to the movable portion 20 by the servomotor 30, where the force is directed in the predetermined direction, and after the force directed in the predetermined direction becomes zero, the control unit 51 starts to apply the force directed in the opposite direction to the movable portion 20 by means of the servo motor 30. In this example, the force directed in the opposite direction, which is applied by the servo motor 30, gradually becomes larger.

It is often the case that the control for changing the directions of the force which is applied by the air cylinder 40 causes a delay, and therefore, the above described control is advantageous for allowing the movable portion 20 to accurately perform desired movements.

On the other hand, in order to reduce the speed of the movable portion 20 between time T6 and time T7, the force directed in the opposite direction is applied to the movable portion 20 by the air cylinder 40 and the servo motor 30.

In order to stop the movable portion 20 at time T8, the control unit 51 starts to apply the force directed in the predetermined direction to the movable portion 20 by the servo motor 30 at a point in time prior to time T8 in a state where the force directed in the opposite direction is continuingly applied to the movable portion 20 by the air cylinder 40. And, the control unit 51 gradually increases the force directed in the predetermined direction by the servo motor to the movable portion 20. Due to this operation, at time T8, the control unit 51 stops the movable portion 20 in a state where the force directed in the opposite direction by the air cylinder 40 is continuously applied to the movable portion 20. In the state where the force directed in the opposite direction is continuously applied to the movable portion 20 by the air cylinder 40, the control of the air cylinder 40 is stable, and therefore, this control is advantageous for accurately performing the stop control of the movable portion 20.

The control unit 51 gradually reduces the force which is applied to the movable portion 20 by the servo motor 30 and the air cylinder 40 after time T8 has passed.

Figure 5:
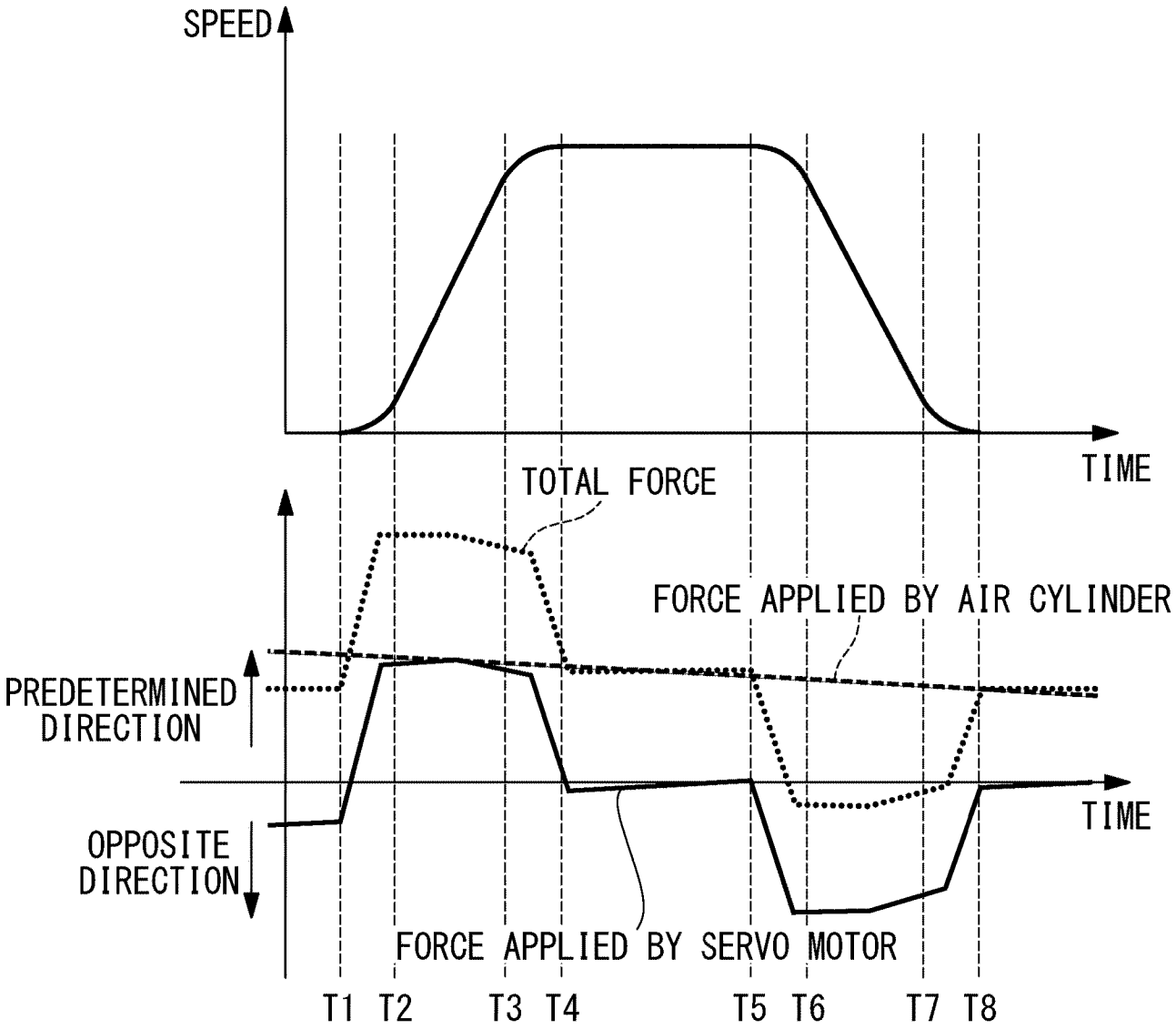
FIG. 5 is a time chart showing another example of the operations of the driving apparatus of the embodiment.

(Example of Control Shown in the Time Chart of FIG. 5)

Figure 4:
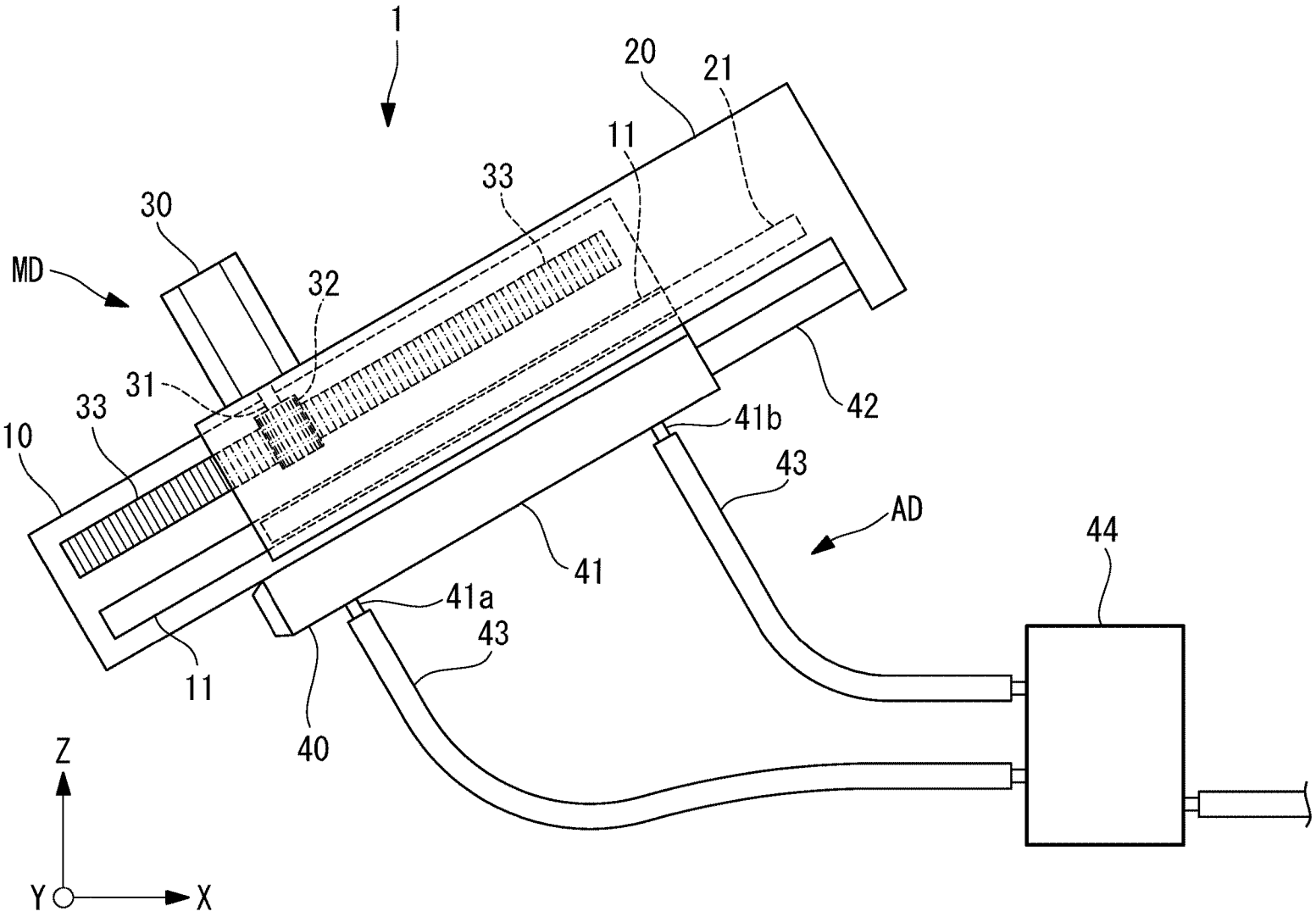
FIG. 4 is a diagram showing an example of arrangement of the driving apparatus of the embodiment.

As shown in FIG. 4, there is a case where one end side of the groove 11 of the base member 10 is higher than the other end side thereof, which inclines the groove 11 in a vertical direction. The control which is shown as the example in FIG. 5 is used under the above described circumstances.

In the example shown in FIG. 5, the control unit 51 starts to move the movable portion 20 toward the predetermined direction from time T1 (start to accelerate the movable portion 20). Also, between time T2 and time T3, the control unit 51 moves the movable portion 20 toward the predetermined direction at the constant acceleration. And, between time T3 and time T5, the control unit 51 gradually reduces the acceleration of the movable portion 20 so that the movable portion 20 moves at the constant speed. Moreover, from time T5, the control unit 51 starts to reduce the speed of the movable portion 20. And, between time T6 and time T7, the control unit 51 reduces the speed of the movable portion 20 at the constant acceleration. And, at time T8, the control unit 51 stops the movable portion 20.

When the control unit 51 starts to move the movable portion 20 at time T1, the control unit 51 starts to control the cylinder controller 44 of the air cylinder drive AD from a point in time prior to time T1 so that the air cylinder 40 starts to apply the force directed in the predetermined direction to the movable portion 20. In this example, the force directed in the predetermined direction, which is applied by the air cylinder 40, does not change, or does not change largely before and after time T1.

On the other hand, the control unit 51 stars to control the servo motor 30 of the motor drive MD from a point in time prior to time T1 so that the servo motors 30 stars to apply the force directed in the direction opposite to the predetermined direction to the movable portion 20. In this example, the force directed in the opposite direction, which is applied by the servo motor 30, does not change, or does not change largely before time T1.

In this state, the force directed in the predetermined direction is being applied to the movable portion 20 by the air cylinder 40, whereas the force directed in the opposite direction is being applied to the movable portion 20 by the servo motor 30, which renders the movable portion 20 stationary. Yet, before time T1, the servo motor 30 may apply the force directed in the predetermined direction to the movable portion 20 in response to degree of the inclination of the groove 11, weight of the movable portion 20, loads applied to the movable portion 20, and the like.

Subsequently, the control unit 51 gradually reduces the force directed in the opposite direction, which is applied by the servo motor 30 at time T1, and after the force directed in the opposite direction becomes zero, the control unit 51 starts to apply the force directed in the predetermined direction to the movable portion 20 by the servo motor 30. In this example, the force directed in the predetermined direction, which is applied by the servo motor 30, gradually becomes larger.

Due to this, at time T1, the movable portion 20 starts to move toward the predetermined direction by the force which is applied by the air cylinder 40.

In this control, from a point in time prior to time T1, the air cylinder 40 starts to apply the force directed in the predetermined direction to the movable portion 20, and the servo motor 30 starts to apply the force directed in the opposite direction to the movable portion 20. Also, from time T1, the control unit 51 starts to reduce the force directed in the opposite direction, which is applied by the servo motor 30. Yet, from time T1, the servo motor 30 may start to apply the force directed in the opposite direction to the movable portion 20. With this control, it is possible to move the movable portion 20 stably at the large acceleration or by the large force from a point in time at which the movement of the movable portion 20 is started.

In the example shown in FIG. 4, the force directed in the predetermined direction is continuingly applied to the movable portion 20 by the air cylinder 40 from a certain point in time which is prior to time T1 to a certain point in time which has passed time T8, and the force directed in the predetermined direction applied by the air cylinder 40 does not change, or does not change largely.

In this state, in order to accelerate the speed of the movable portion 20 between time T2 and T3, the force directed in the predetermined direction is applied to the movable portion 20 by the servo motor 30.

Between time T3 and time T5, in a state where the force directed in the predetermined direction is continuingly applied to the movable portion 20 by the air cylinder 40, the control unit 51 gradually reduces the force directed in the predetermined direction, which is applied to the movable portion 20 by the servo motor 30, and when the force which is applied to the movable portion 20 by the servo motor 30 becomes small, the control unit 51 maintains the state.

On the other hand, in order to reduce the speed of the movable portion 20 between time T6 and time T7, the control unit 51 applies the force directed in the opposite direction to the movable portion 20 by the servo motor 30 in a state where the force directed in the predetermined direction by the air cylinder 40 is continuingly applied to the movable portion 20.

In order to stop the movable portion 20 at time T8, the control unit 51 gradually reduces the force directed in the opposite direction, which is applied to the movable portion 20 by the servo motor 30, in a state where the force directed in the predetermined direction by the cylinder 40 is continuingly applied to the movable portion 20. Also, the control unit 51 applies a differential force between the force directed in the opposite direction, which is applied to the movable portion 20 in response to the weight of the movable portion 20 and the loads applied to the movable portion 20, and the force directed in the predetermined direction, which is applied to the movable portion 20 by the air cylinder 40. The control unit 51 applies the differential force to the movable portion 20 by the servo motor 30. Due to this operation, at time T8, in a state where the force directed in the predetermined direction is continuously applied to the movable portion 20 by the air cylinder 40, the control unit 51 stops the movable portion 20. In the state where the force directed in the predestined direction is continuously applied to the movable portion 20 by the air cylinder 40, the control of the air cylinder 40 is stable, and therefore, this control is advantageous for accurately performing the stop control of the movable portion 20.

Accordingly, in this embodiment, the control unit 51 moves the movable portion 20 toward the predetermined direction by using both of the air cylinder drive AD and the motor drive MD. Therefore, it is possible to downsize the servo motor 30 of the motor drive MD by the size of the air cylinder drive AD, and it is possible to suppress an increase in the weight of the driving apparatus 1. Also, the air cylinder 40 generates the large force in response to the area of the piston, air pressure, and the like. Accordingly, the driving apparatus 1 using the air cylinder drive AD and the motor drive MD is capable of generating the large force.

Here, the servo motor 30 is accompanied with a current amplifier (an amplifier), and the current amplifier in different size, types, and the like are used in response to output and the like of the servo motor 30. Also, different power supply devices, control software, and the like are required in response to the size, the types, and the like of the current amplifier. For that reason, in order to use a relatively large servo motor 30, a large sized current amplifier, a large sized power supply device, and the like are required, which enlarges the size of the driving apparatus and increases costs. In this embodiment, a relatively small servo motor 30 is used to generate the large force, and therefore, the size of the current amplifier, the power supply device, and the like can relatively be small and what is more, it is possible to suppress the cost.

Also, in this embodiment, the control unit 51 applies the force directed in the predetermined direction to the movable portion 20 by the motor drive MD while the control unit 51 moves the movable portion 20 toward the predetermined direction, which complements the force directed in the predetermined direction, which is applied to the movable portion 20 by the air cylinder drive AD.

Therefore, the driving apparatus 1 is capable of generating the large force, and what is more, the driving apparatus 1 is capable of accurately controlling the large force by means of the servo motor 30 of the motor drive MD.

Moreover, in this embodiment, the control unit 51 applies the force directed in the direction opposite to the predetermined direction to the movable portion 20 by the motor drive MD while the control unit 51 moves the movable portion 20 toward the predetermined direction, which counterbalances a part of the force directed in the predetermined direction, which is applied to the movable portion 20 by the air cylinder drive AD.

Generally, it is difficult to switch generation directions and magnitude of the force of the air cylinder 40 accurately in a short period of time. In this embodiment, it is possible to reduce the speed of the movable portion 20, stop the movable portion 20, and the like by means of the motor drive MD in a state where the force directed in the predetermined direction is continuingly applied to the movable portion 20 by the air cylinder drive AD. That is to say, by virtue of the presence of the air cylinder drive AD, the driving apparatus 1 is capable of generating the large force. And what is more, it is also possible to control the movement of the movable portion 20 accurately.

Also, the connection state of the base member 10 and the movable portion 20 is not limited to the example shown in FIG. 1 as long as the movable portion 20 is movable toward the predetermined direction with regard to the base member 10. Moreover, the configuration of the motor drive MD and that of the air cylinder drive AD are not limited to the example shown in FIG. 1 as well. For the motor drive MD, any motor drive is applicable as long as it can move the movable portion 20 toward the predetermined direction by means of the output of the servo motor 30, and for the air cylinder drive AD, any air cylinder motor drive is applicable as long as it can move the movable portion 20 toward the predetermined direction by means of the output of the air cylinder 40.

A driving apparatus 2 according to a second embodiment of the present invention will be described below with reference to the accompanying drawings.

Figure 6:
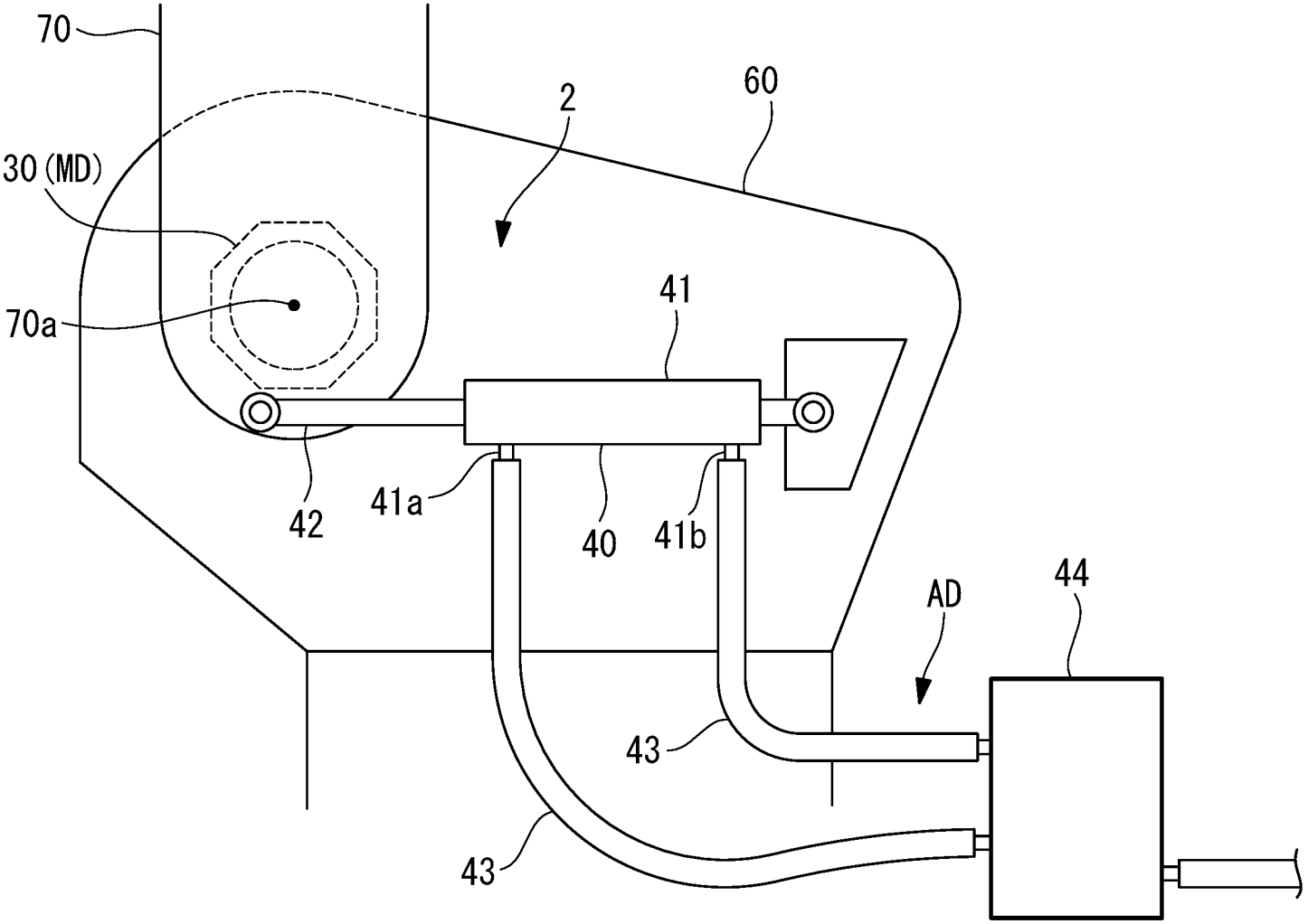
FIG. 6 is a front view of a driving apparatus according to a second embodiment.

As shown in FIG. 6, the driving apparatus 2 in the second embodiment has a motor drive MD for swinging a movable portion 70, which is supported by a base side member 60, about a swing axis line 70*a*, and an air cylinder 40 which has an output shaft 42 whose distal end is connected to the movable portion 70, and which is the same as or similar to the air cylinder 40 described in the first embodiment.

The base side member 60 is, for example, an arm member which is located at a position closest to the base of a robot, such as a vertical articulated robot and the like, and the movable portion 70 is an arm member which is located at a position second closest to the base of the robot. One end portion of the movable portion 70 is supported by the base side member 60 so as to be swingable about the swing axis line 70*a*. In addition, the movable portion 70 may be other arm members of the robot, and in that case, the base side member 60 is an arm member which is located closer to the base than the movable portion 70.

The motor drive MD has a servo motor 30, and the servo motor 30 is fixed to the base side member 60. The output shaft, which rotates in response to the output of the servo motor 30, is connected to the movable portion 70, and the movable portion 70 swings about the swing axis line 70*a* by the servo motor 30.

A proximal portion of a main body 41 of the air cylinder 40 is connected to the base side member 60, and a distal end portion of the output shaft 42 of the air cylinder 40 is connected to a position which is distant from the swing axis line 70*a* of the movable portion 70. In the example shown in FIG. 6, the distal end portion of the output shaft 42 is connected to one end of the movable portion 70. The main body 41 is connected to the base side member 60 so as to be swingable in the up and down direction, and the output shaft 42 is also connected to the movable portion 70 so as to be swingable in the up and down direction. With this configuration, force, which swings the movable portion 70 in response to the movement of the air cylinder 40, is applied to the one end of the movable portion 70.

The driving apparatus 2 of the second embodiment also has a controller 50 which is the same as or similar to that in the first embodiment, and a system program 53*a* and an operation program 53*b* are stored in a storage unit 53 of the controller 50. The operation program 53*b* is a series of control commands which is for controlling the servo motor 30 and a cylinder controller 44 so as to make the movable portion 70 perform a predetermined operation.

In the second embodiment, the control unit 51 also moves the movable portion 70 toward a predetermined direction (a predetermined swing direction or a predetermined rotation direction) by using both of the air cylinder drive AD and the motor drive MD. Therefore, it is possible to downsize the servo motor 30 of the motor drive MD by the size of the air cylinder drive AD, and it is possible to suppress an increase in the weight of the driving apparatus 2. Also, the air cylinder 40 generates the large force in response to the area of the piston, air pressure, and the like. Accordingly, the driving apparatus 2, which uses the air cylinder drive AD and the motor drive MD, is capable of generating the force larger than that generated by the motor drive MD alone.

And, in the second embodiment, the control unit 51 also applies the force directed in a predetermined direction to the movable portion 70 by the motor drive MD while the control unit 51 moves the moveable portion 70 toward the predetermined direction. By this operation, the control unit 51 performs the control so as to complement the force directed in the predetermined direction, which is applied to the movable portion 70 by the air cylinder drive AD.

For that reason, the driving apparatus 2 is capable of generating the large force, and what is more, the driving apparatus 2 is capable of accurately controlling the large force by means of the servo motor 30 of the motor drive MD.

Moreover, in the second embodiment, the control unit 51 also applies force directed in the direction opposite to the predetermined direction to the movable portion 70 by the motor drive MD while the control unit 51 moves the movable portion 70 toward the predetermined direction. By this operation, the control unit 51 perfumes the control so as to counterbalance a part of the force directed in the predetermined direction, which is applied to the movable portion 70 by the air cylinder drive AD.

Generally, it is difficult to switch generation directions and magnitude of the force of the air cylinder 40 accurately in a short period of time. In the second embodiment, it is possible to reduce the speed of the movable portion 70, stop the movable portion 70, and the like by means of the motor drive MD in a state where the force directed in the predetermined direction is continuingly applied to the movable portion 70 by the air cylinder drive AD. That is to say, by virtue of the presence of the air cylinder drive AD, the driving apparatus 2 is capable of generating the large force. And what is more, it is also possible to control the movement of the movable portion 70 accurately.

Also, the connection state of the base side member 60 and the movable portion 70 is not limited to the example shown in FIG. 6 as long as the movable portion 70 is swingable or rotatable toward a predetermined direction with regard to the base side member 60. Also, the configuration of the motor drive MD and that of the air cylinder drive AD are not limited to the example shown in FIG. 6. For the motor drive MD, any motor drive is applicable as long as it can move the movable portion 70 toward the predetermined direction by means of the output of the servo motor 30, and for the air cylinder drive AD, any air cylinder drive is applicable as long as it can move the movable portion 70 toward the predetermined direction by means of the output of the air cylinder 40.

The following aspects are derived from the above disclosure.

A driving apparatus according to a first aspect of the present invention includes a motor drive capable of moving a movable portion toward a predetermined direction by means of output of a servo motor; an air cylinder drive capable of moving the movable portion toward the predetermined direction by means of output of an air cylinder; and a controller which controls the motor drive and the air cylinder drive, wherein the controller moves the movable portion toward the predetermined direction by using the air cylinder drive and the motor drive.

In this aspect, the controller moves the movable portion toward the predetermined direction by using both of the air cylinder drive and the motor drive, and therefore, it is possible to downsize the servo motor of the motor drive by the size of the air cylinder drive, which suppresses an increase in the weight of the driving apparatus. Also, the air cylinder generates large force in response to the area of the piston, air pressure, and the like. Therefore, the driving apparatus using the air cylinder drive and the motor drive is capable of generating the large force.

In the above described aspect, preferably, the controller applies force directed in the predetermined direction to the movable portion by the motor drive while the controller moves the movable portion toward the predetermined direction so that the force applied by the motor drive complements the force applied by the air cylinder drive directed in the predetermined direction to the movable portion.

In the above described aspect, the driving apparatus is capable of generating the large force, and what is more, the driving apparatus is capable of accurately controlling the large force by means of the servo motor of the motor drive.

In the above described aspect, preferably, the controller applies force directed in a direction opposite to the predetermined direction by the motor drive while the controller moves the movable portion toward the predetermined direction so that the force applied by the motor drive counterbalances a part of the force directed in the predetermined direction applied by the air cylinder drive to the movable portion.

Generally, it is difficult to switch control of generation directions and magnitude of the force of the air cylinder accurately in a short period of time. In this aspect, it is possible to reduce the speed of the movable portion, stop the movable portion, and the like by means of the motor drive in a state where the force directed in the predetermined direction is continuingly applied to the movable portion by the air cylinder drive. That is to say, by virtue of the presence of the air cylinder drive, the driving apparatus is capable of generating the large force. And what is more, it is also possible to control the movement of the movable portion accurately.

In the above described aspect, preferably, the movable portion is supported by a base side member so as to be swingable about a swing axis line, and the motor drive and the air cylinder drive are capable of swinging the movable portion toward a predetermined direction around the swing axis line.

In this case, the driving apparatus using the air cylinder drive and the motor drive can generate the large force in order to swing the movable portion.

According to the above aspects, a driving apparatus is capable of generating large force while suppressing an increase in weight of the driving apparatus.

REFERENCE SIGNS LIST

1, 2 driving apparatus
10 base member
11 groove
20 movable portion
21 rail
30 servo motor
31 output shaft
32 pinion gear
33 rack gear
40 air cylinder
41 main body
41*a*, 41*b* intake and exhaust ports
42 output shaft
44 cylinder controller
50 controller
51 control unit
53 storage unit
53*a* system program
53*b* operation program
60 base side member
70 movable portion
MD motor drive
AD air cylinder drive

The invention claimed is:

1. A driving apparatus comprising:

a motor drive capable of moving a movable portion toward a predetermined direction by an output of a servo motor;

an air cylinder drive capable of moving the movable portion toward the predetermined direction by an output of an air cylinder; and a controller which controls the motor drive and the air cylinder drive, wherein:

the controller is configured to control the air cylinder to apply force, which is directed in the predetermined direction, to the movable portion beginning at a time point prior to a movement starting time of the movable portion in the predetermined direction;

the controller is configured to control the servo motor to apply force, which is directed in an opposite direction that is opposite to the predetermined direction, to the movable portion beginning at a time point prior to the movement starting time, and the controller then controls the servo motor to reduce the force directed in the opposite direction so that the movable portion is moved in the predetermined direction at the movement starting time.

2. The driving apparatus according to claim 1, wherein the controller applies force directed in the predetermined direction to the movable portion by the motor drive while the controller moves the movable portion toward the predetermined direction so that the force applied by the motor drive complements the force applied by the air cylinder drive directed in the predetermined direction to the movable portion.

3. The driving apparatus according to claim 1, wherein the controller applies force directed in a direction opposite to the predetermined direction by the motor drive while the controller moves the movable portion toward the predetermined direction so that the force applied by the motor drive counterbalances a part of the force directed in the predetermined direction applied by the air cylinder drive to the movable portion.

4. The driving apparatus according to claim 1, wherein the movable portion is supported by a base side member so as to be swingable about a swing axis line, and the motor drive and the air cylinder drive are capable of swinging the movable portion toward a predetermined direction around the swing axis line.

* * * * *